US005340174A

United States Patent [19]

Bender et al.

[11] Patent Number: 5,340,174

[45] Date of Patent: Aug. 23, 1994

[54] MOUNTING ARRANGEMENT FOR VEHICLE DOOR HANDLE

[75] Inventors: Frederick F. Bender, South Lyon; Earl L. Watson, Walled Lake, both of Mich.

[73] Assignee: Chrysler Corporation, Highland Park, Mich.

[21] Appl. No.: 44,686

[22] Filed: Apr. 12, 1993

[51] Int. Cl.[5] ..... E05B 5/00

[52] U.S. Cl. ..... 292/336.3; 70/208; 70/466; 74/523; 74/545; 292/347; 292/DIG. 31; 292/DIG. 53; 292/DIG.64

[58] Field of Search ..... 70/208, 210, 466; 292/336.3, 347, DIG. 31, DIG. 53, DIG. 64; 248/27.1, 222.2; 74/523, 545

[56] References Cited

U.S. PATENT DOCUMENTS

| | | | |
|---|---|---|---|
| 2,790,181 | 4/1957 | McCarthy | 4/187 |
| 3,153,553 | 10/1964 | Sandor | 292/336.3 |
| 3,967,844 | 7/1976 | Torii et al. | 292/336.3 |
| 4,038,718 | 8/1977 | Reilhac et al. | 16/110 R |
| 4,475,415 | 10/1984 | Yamamoto | 74/543 |
| 4,588,219 | 5/1986 | Kobayashi et al. | 292/336.3 |
| 4,778,207 | 10/1988 | Gergoe | 292/336.3 |
| 4,838,054 | 9/1989 | Weinerman et al. | 70/208 |
| 4,892,342 | 1/1990 | Newman et al. | 292/347 |
| 4,924,582 | 5/1990 | Keller | 29/434 |
| 5,238,276 | 8/1993 | Burns | 292/DIG. 53 X |
| 5,248,175 | 9/1993 | Burns | 292/DIG. 31 X |
| 5,284,373 | 2/1994 | Watson | 292/DIG. 64 X |

*Primary Examiner*—Lloyd A. Gall
*Attorney, Agent, or Firm*—Edward P. Barthel

[57] ABSTRACT

A handle assembly is adapted for installation in a vehicle panel aperture having a flanged border from the outboard side of the panel. The handle housing has a pre-installed attaching clip retained on the housing by a screw tightened to an initial setting enabling predetermined upward and inward travel of the clip between a lower gravity induced position to an installation rocked-in induced upper position. The clip has tapered flanges configured to bear on the aperture border during rocked-in movement of the housing along a determined swingline. Upon clip tabs being positioned inboard of the border the tapered flanges disengaging the border thereby returning the clip by gravity to its installed position such that tightening the screw clamps the tabs against the aperture border.

10 Claims, 4 Drawing Sheets

MOUNTING ARRANGEMENT FOR VEHICLE DOOR HANDLE

BACKGROUND OF THE INVENTION

This invention relates generally to vehicle outside door handle assemblies and, more particularly, to an arrangement for mounting a vehicle outside handle assembly in an aperture of a body door panel.

One example of a prior art outside door handle mounting arrangement presently used on Chrysler Corporation vehicles is shown in the U.S. Pat. No. 4,892,342 issued to Newman et al. on Jan. 9, 1990. Vehicle door handles, such as the Newman et al. handle, are received at the vehicle assembly plant separate from the attaching brackets and fastener end item parts required to mount the handle to the door panel. Such a procedure requires a substantial number of end item parts be handled separately from the door handle together with several manual operations needed to attach the handle to the door panel using the brackets and fastener parts.

SUMMARY OF THE INVENTION

Accordingly, it is a feature of the present invention to provide a novel mounting arrangement for securing a handle assembly in a vehicle panel aperture that is relatively easy, efficient and inexpensive to utilize.

It is another feature of the present invention to provide a mounting arrangement for securing a vehicle handle assembly in a panel aperture wherein a novel attaching clip is attached in a first pre-installed position on the assembly housing for ready predetermined movement between the first pre-installed position, a second intermediate raised position induced by rocking the housing into the panel aperture along a predetermined swing-line, and a third gravity induced panel mounted position.

It is yet another feature of the present invention to provide a handle assembly mounting arrangement as set forth above wherein a single threaded self-tapping fastener is initially driven into the housing to a first threaded setting attaching the clip in a pre-installed position and thereafter the fastener being torqued down upon the clip moving to its third gravity induced position.

It is still another object of the present invention to provide a mounting arrangement for securing a handle assembly in a vehicle panel aperture as set forth above whereby rocking the handle assembly into the panel aperture along a swingline causes the attaching clip to be cammed upwardly in a predetermined manner to its second raised position by tapered portions on the clip adapted to engage a lower portion of the aperture flanged border.

It is a yet another object of the present invention to provide an attaching arrangement as set forth above whereby ramp means on the housing causes predetermined inboard movement of the clip in conjunction with its upward movement during installation in the panel aperture allowing the clip to initially clear the aperture lower flanged border and thereafter the inboard ramp means enabling the clip to be returned by gravity to the handle assembly installed position such that retaining means formed on the clip is located juxtaposed an inboard lower edge of the flanged border.

It is yet a further object of the present invention to provide an attaching arrangement as set forth above wherein the installer, upon torquing the threaded fastener to its final setting, causes the clip retaining means to engage the flanged border thereby releasably locking the handle assembly in the panel aperture.

It is still another object of the present invention to provide a novel attaching arrangement for securing a vehicle handle assembly in a panel aperture as wherein the handle housing has support means formed thereon adapted to guide the single retaining clip for predetermined elevated travel from a first pre-installed position to a second raised position and thence to a third gravity induced installed position wherein a handle housing terminal flange is seated on the outboard surface of the aperture flanged border.

The handle assembly comprises a housing formed with a terminal flange surrounding a central body adapted for flush installation from the exterior of a vehicle panel provided with an aperture formed with a recessed flanged border. Integral support means are molded on the central body supporting a generally L-shaped clip formed with an upstanding head panel and an outboard sloped base panel. The clip head panel has an elongated vertical slot receiving a single threaded fastener therethrough for self-tapping insertion in a housing bore to an initial pre-installed setting. In its pre-installed mode, the clip is adapted for predetermined upward and inboard travel on the housing between the first pre-installed position, a second upwardly cammed position resulting from rock-in travel into the panel aperture along an arcuate swing-line path, and a third gravity induced secured position wherein the clip secures the handle assembly in the panel aperture.

The housing is formed with fore and aft upstanding bracket means adapted to pivotally support fore and aft crankarms of a release handle. An installer inserts the handle assembly in the panel aperture by tipping the assembly inboard such that the upstanding crankarms project through the panel aperture. The panel recessed flanged border, which forms a longitudinally extending notched juncture, is adapted to initially receive and seat the upper edge of the handle housing. As a result, the housing assembly is longitudinally positioned while establishing an installation pivot enabling the installer to rock the housing into the aperture along a predetermined swingline about the installation pivot. Such longitudinal positioning enables a pair of inboard projecting threaded studs, longitudinally spaced on the housing backside, to be received in associated vertically extending upper slots formed in corner fillets of the aperture flanged border.

The L-shaped retaining clip of the present invention, comprising an upstanding head panel and an outboard projecting base panel, is adapted to secure the lower portion of the handle assembly. The clip base panel has its free edge formed with a pair of locating fingers projecting outboard therefrom adapted, in the pre-installed position, to engage a support ledge provided by a lower portion of the housing terminal flange. The clip base panel free edge further includes a pair of downturned retaining tabs the outboard faces of which are spaced a predetermined dimension from the terminal flange backside in the clip pre-installed position. A pair of camming flanges, formed on either side of the clip base panel, each have a tapered edge adapted to slidably bear on a lower portion of the aperture border upon the housing being rocked inboard along its swingline. The tapered edges cam the clip upwardly while a pair of longitudinally spaced ramps are formed at the juncture of the housing central portion with the terminal flange lower portion. The ramps are adapted to slidably contact radiused bend junctures of the clip retaining tabs so as to move the clip to a predetermined inboard location as it is being elevated to clear the aperture lower flanged border.

Upon the housing terminal flange being seated on the flanged border, the clip cam flanges are swung inboard of the aperture flanged border. As a result, the clip is released for downward travel by gravity to its predetermined third installed position wherein the retaining tabs are juxtaposed the inboard surface of the flanged border. Tightening the screw fastener to its second setting causes the clip fingers to be held in contact with the aperture lower flanged border upper edge. This prevents clip rotation while the downturned tabs abut on the flanged border inboard surface thereby applying a bearing load thereto.

BRIEF DESCRIPTION OF THE DRAWINGS

Other features and advantages of the invention, such as improved appearance and service disassembly, will be evident from the following detailed description of the preferred embodiment of the invention and the accompanying drawings wherein.

DETAILED DESCRIPTION OF THE INVENTION

Figure 1:
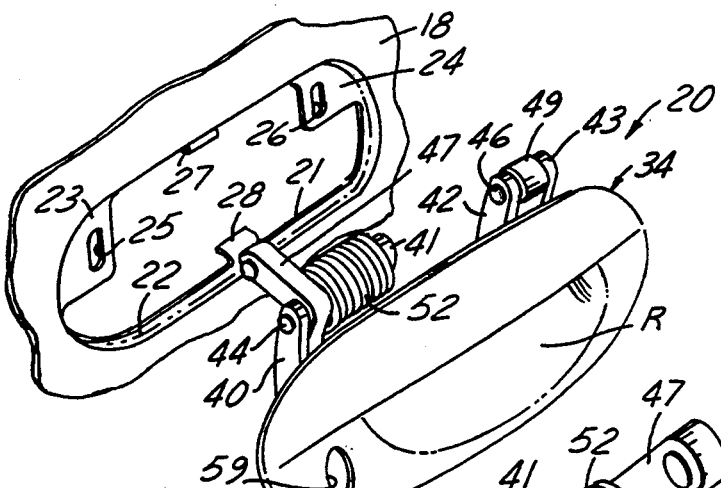
FIG. 1 is a fragmentary exploded perspective view of a door panel outer surface having an aperture therein and a door handle assembly of the present invention shown positioned for insertion in the panel aperture.
Figure 18:
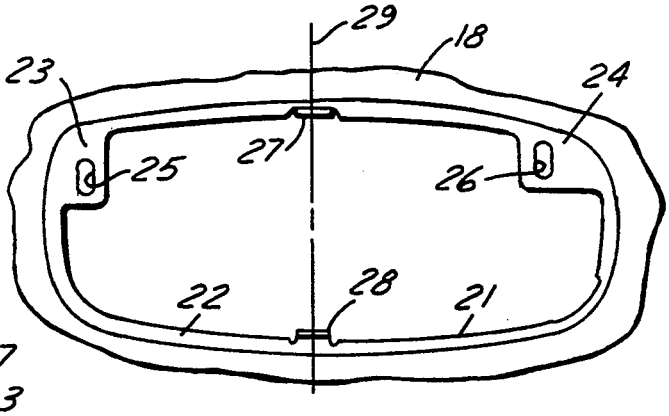
FIG. 18 is a fragmentary plan view of the panel aperture showing the interior surface of the panel.

Referring now to the drawings, and more particularly to FIG. 1, wherein a portion of a vehicle panel, partially indicated at 18, has an outboard surface and an inboard surface. The panel 18, which in the disclosed embodiment is a vehicle sheet metal exterior door panel, includes a flush type exterior or outside door handle assembly 20 for operating a door latch mechanism (not shown). The panel 18 is formed with a generally oval-shaped handle aperture 21 configured to accommodate the handle assembly 20. The panel aperture 21 is defined by a counter-sunk or recessed generally oval-shaped continuous flanged border 22 off-set or recessed inboard and substantially conforming to the aperture 21 and lying in a plane matching the contour of the panel 18. The flanged border 22 has a pair of fore 23 and aft 24 upper corner fillets each provided with a vertically extending mounting slot 25 and 26, respectively. The flange border is also formed with upper and lower vertically opposed inwardly projecting lugs 27 and 28, respectively. As seen in FIG. 18, the lugs 27 and 28, which are used to position door assembly tooling, are formed in mirror image relation and are aligned on aperture vertical center line 29. The panel aperture 21 is adapted to receive the handle assembly 20 from the outboard side of the panel 18 in a "rock-in" manner along a swingline to be described below.

Figure 2:
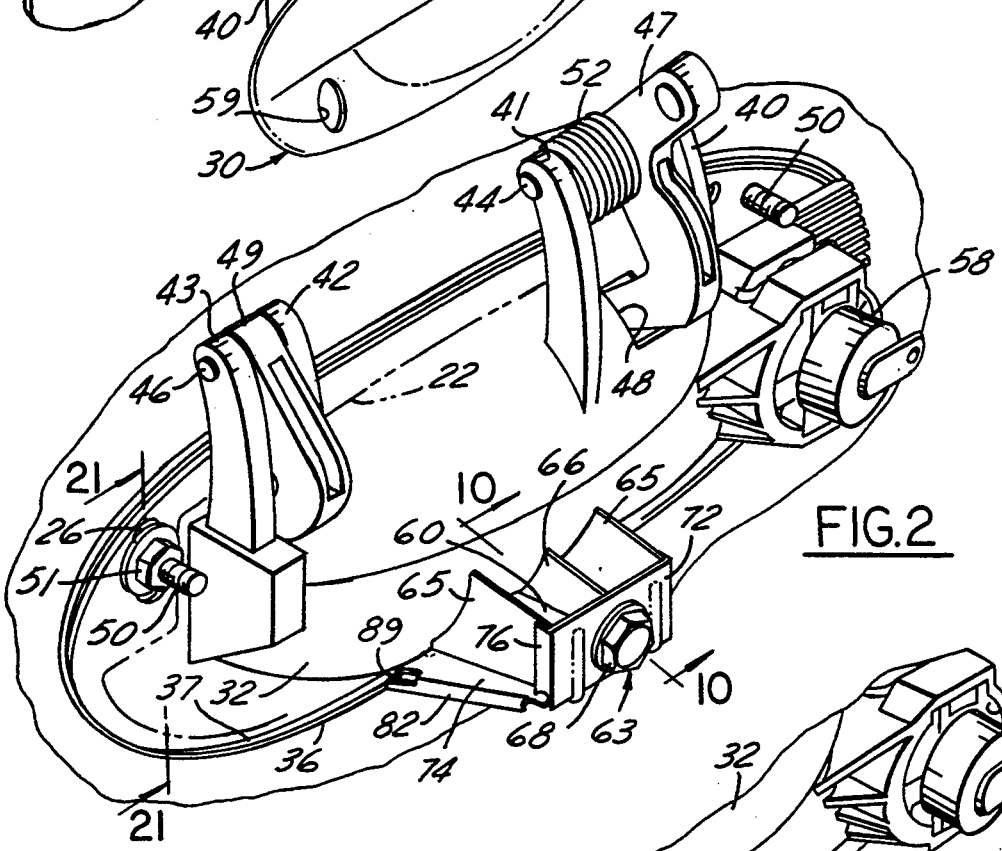
FIG. 2 is a perspective view of the inboard side of the door handle assembly showing an attachment bracket and mounting fastener.
Figure 10:
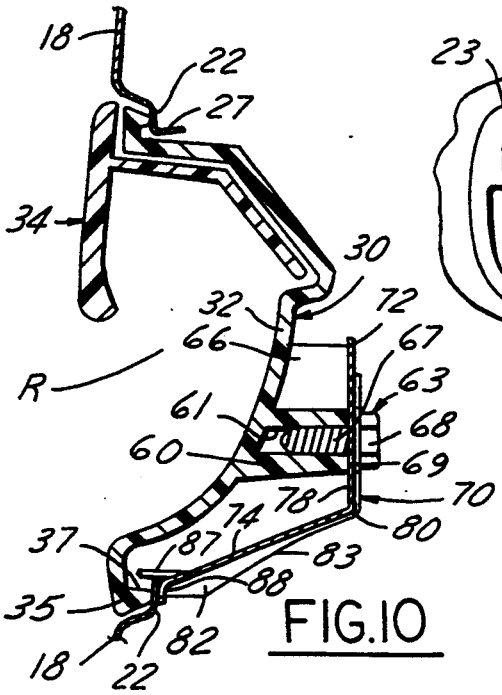
FIG. 10 is a fragmentary vertical cross sectional view, partly in elevation, taken on a vertical cross section through the principal axis of the threaded stud showing the attaching clip in its installed and locked mode.

With reference to FIGS. 1 and 2, the handle assembly 20 includes a housing member, generally indicated at 30, having a main inboard depressed body portion 32 defining an outboard facing generally oval-shaped central recess "R" (FIG. 10). The recess "R" is sized for inserting the operator's fingers behind a release handle member, generally indicated at 34, pivotally mounted on the housing for location between an extended operable position and a retracted inoperable position within the recess. FIGS. 1, 2, and 10 show the housing member central body portion 32 formed with an integral continuous outer terminal flange 36 extending around the periphery of the body portion 32. The terminal flange 36 has its backside overlying the exterior surface of the matching panel aperture flanged border 22. The lower portion of the terminal flange is "cored-out" defining a recessed lower support ledge 37.

Figure 3:
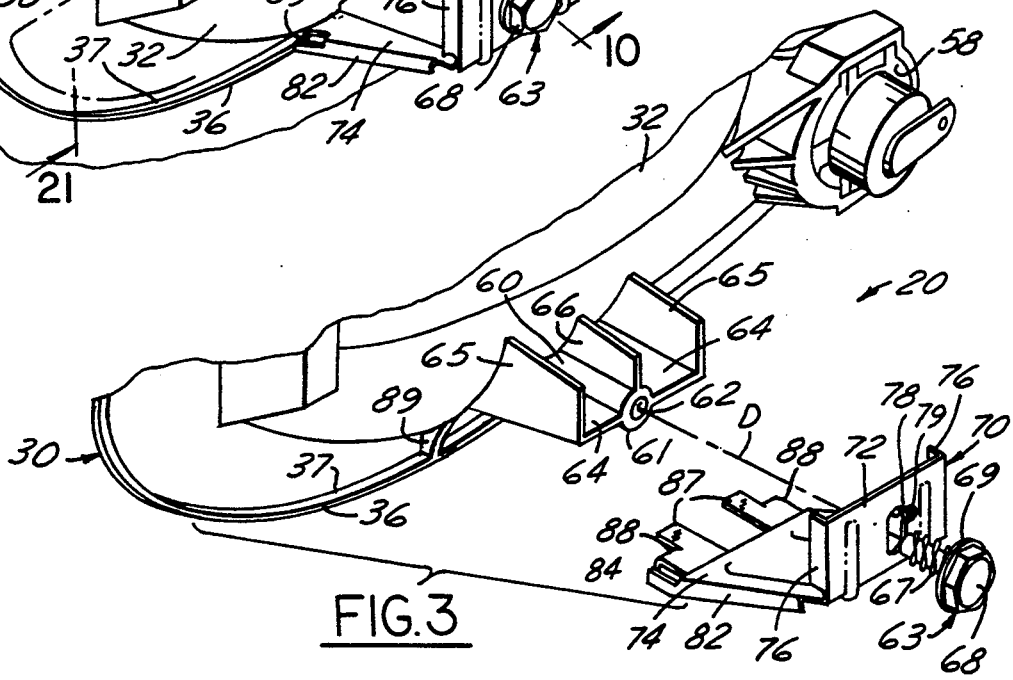
FIG. 3 is a fragmentary exploded perspective view of the handle housing inboard surface area together with its associated attaching clip and self-tapping screw.

With reference to FIGS. 1–3, the housing 30, which is preferably molded from a polymeric or plastic mineral filled material, has its central body portion 32 integrally formed with a forward or first upwardly extending pair of handle support brackets 40 and 41 and a second or aft pair of handle support brackets 42 and 43. The first pair of support brackets 40 and 41, longitudinally spaced in a relatively extended manner, are positioned adjacent the forward end of the housing member. The second pair of brackets 42 and 43, longitudinally spaced in a relatively close manner, are located adjacent the aft end of the housing. The first pair of brackets 40 and 41 support a forward pivot pin 44 therebetween, aligned on a common longitudinally extending pivotal axis "A"(FIG. 6), while an aft pivot pin 46 is supported between the aft brackets 42 and 43.

Figure 21:
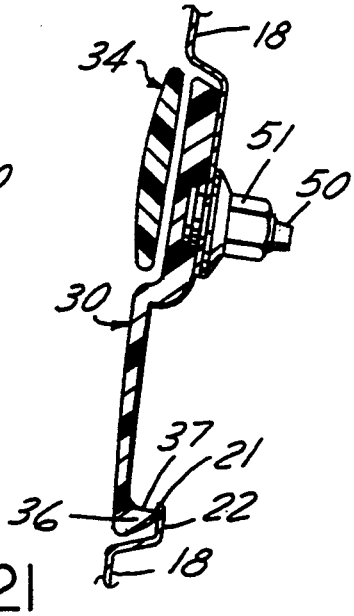
FIG. 21 is a fragmentary sectional view taken on the line 21—21 of FIG. 2.

FIGS. 1 and 2 show the handle member 34 integrally formed with a forward crankarm 47 projecting through a forward slot 48 in the housing 30 while aft crankarm 49 projects through an aft slot (not shown) in the housing. The first crankarm 47 is pivotally supported on pivot pin 44 extending between the forward brackets 40, 41 while the second crankarm 49 is pivotally supported on pivot pin 46 extending between the aft brackets 42, 43. A pair of upper threaded studs 50 are molded in the housing and are adapted to be received in associated panel fillet slots 25 and 26 and secured by nuts 51, as seen in FIGS. 2 and 21.

Figure 6:
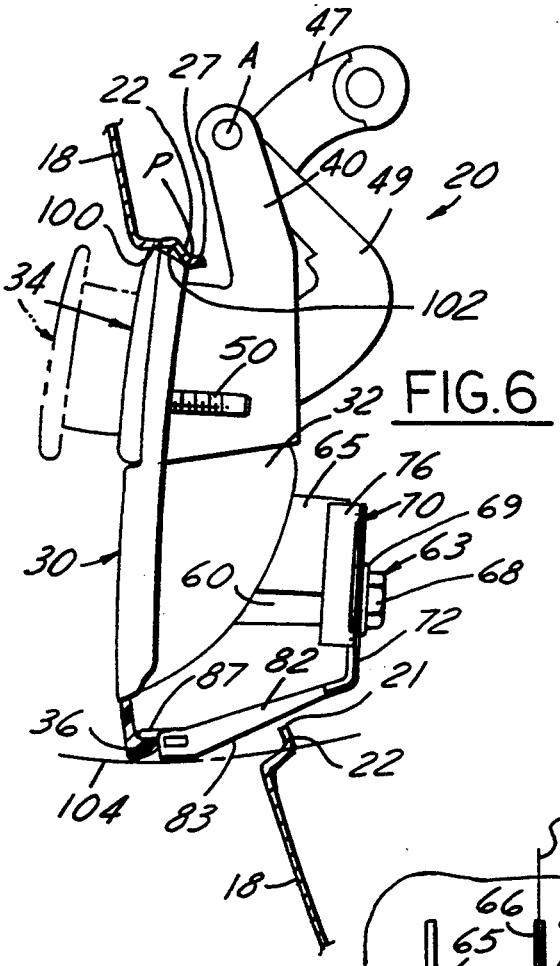
FIG. 6 is a fragmentary end view, partly in section, of the door handle assembly partially inserted in the panel aperture with the handle upper longitudinal edge portion seated and a pair of upper corner threaded bolts partially inserted in their respective slotted apertures.

The release handle 34 is rotated about the pivot pins 44 and 46 in a clockwise direction, as viewed in FIG. 6, from its non-use solid line position in the housing member recess to its operating dashed line position (FIG. 6) against the biasing force of a helical spring 52 coiled around the forward pivot pin 44 to actuate the door latch mechanism (not shown) enabling the door to be opened. The spring 52 has one end (not shown) hooked to the crankarm 47 and its other end (not shown) received in a retaining groove formed in the housing member biasing the gripping portion of the handle toward its non-use flush position. The spring 52 is in pressure contact with the pivot pin 44 so as to transfer its reaction force thereto.

It will be seen in FIGS. 2 and 3 that an integral cylindrical shaped hollow socket portion 58, shown formed adjacent the forward end the housing 30, has an entrances hole 59 (FIG. 1). The socket portion 58 is adapted for the reception of a conventional lock cylinder as shown in the handle of the above mentioned Newman U.S. Pat. No. 4,892,342, for example. It will be noted, however, that a vehicle outside door handle for the rear doors of a four-door sedan model may omit a lock cylinder, if desired.

Figure 9:
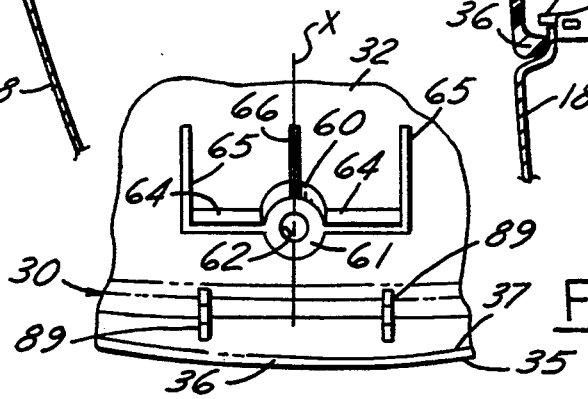
FIG. 9 is a view similar to FIG. 4 without the attaching clip.

With reference to FIGS. 3, 6 and 9, it will be seen that the inboard convex surface of the housing central body portion 32 is formed with an integral inboard extending central attaching clip support means. The clip support means comprises a housing central hub 60 having its free end 61 provided with a blind bore 62, having a principal axis "D", adapted to receive a hexhead flanged tapping screw, generally indicated at 63 in FIG. 3. The central hub 60 has a pair of horizontally disposed mirror image gussets 64 integrally molded therewith and extending from either side of the hub 60 in a co-planar manner. A pair of vertically disposed integral guide fins 65, extend inboard from the housing body portion 32, are equally spaced on either side of a central fin 66 extending vertically upwardly from the hub 60. It will be noted in FIG. 9 that the lower end of each side fin 65 joins the free end of its associated hub gusset 64 at a right angle juncture. The stem blind bore 62 is shown in FIG. 10 threadably receiving therein the tapping screw 63 which comprises a threaded shank 67, a hex driving head 68 and a head flange 69.

As viewed in FIGS. 2 and 3, the handle housing central fastening arrangement comprises a one-piece retaining clip, generally indicated at 70, formed from suitable sheet stock such as Sheet metal. The clip 70 is initially in the form of a stamped flat blank "B", shown in FIG. 17, and is subsequently formed by suitable stamping machine dies into the clip 70 configuration of detail FIGS. 14–16. The clip 70, as seen in perspective in FIGS. 11–14, is generally L-shaped in vertical cross section comprising an upstanding head panel 72 and an outwardly and downwardly sloped body panel 74 with both panels being generally rectangular in plan. The clip is formed symmetrically about a vertical plane of symmetry defined by dashed axis of symmetry "C" in FIG. 16. The head panel 72 has its opposite side edges provided with vertically disposed right-angled mirror image guide flanges 76 extending outboard therefrom. The guide flanges 76 are laterally spaced a predetermined dimension as explained below.

Figure 11:
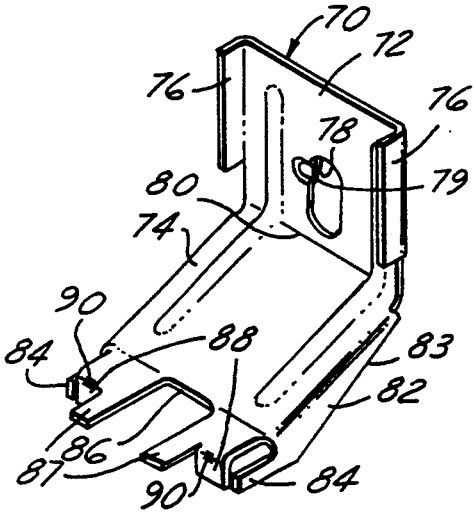
FIG. 11 is an enlarged detail perspective view of the attaching clip of the present invention in its upright position.
Figure 12:
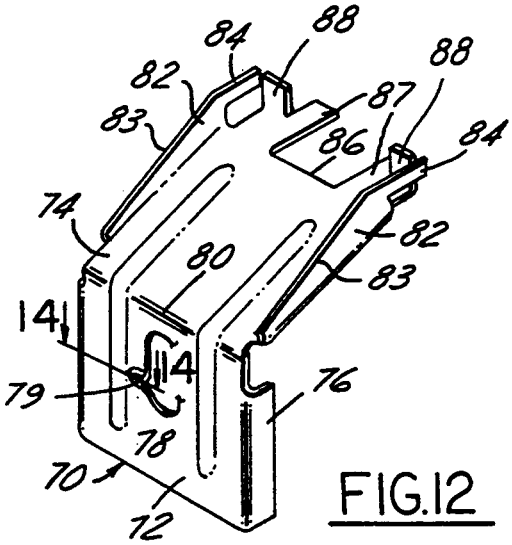
FIG. 12 is a detail view similar to FIG. 12 showing the underside of the attaching clip.
Figure 13:
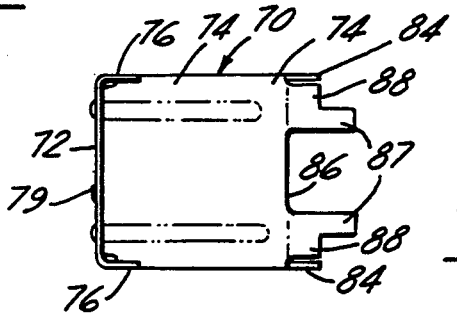
FIG. 13 is a top plan detail view of the attaching clip of FIG. 11.
Figure 14A:
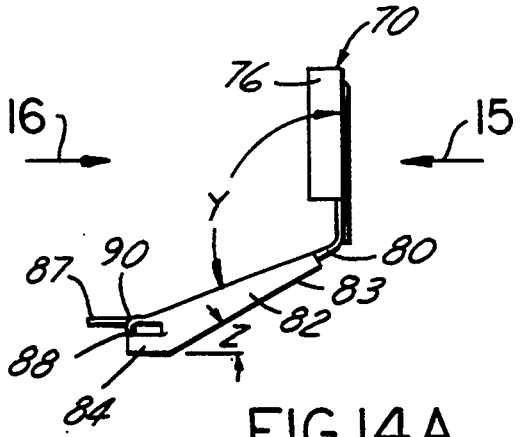
FIG. 14A is a side view of the clip of FIG. 12.
Figure 15:
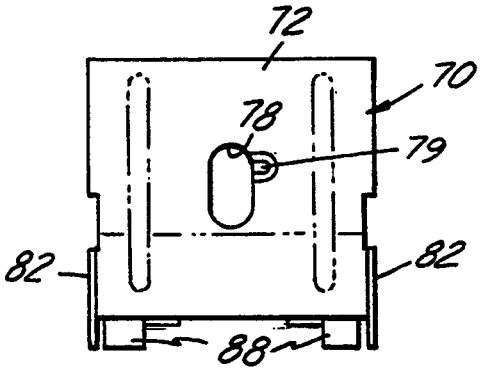
FIG. 15 is a detail end view of the clip taken in the direction of arrow "FIG. 15" in FIG. 14.
Figure 16:
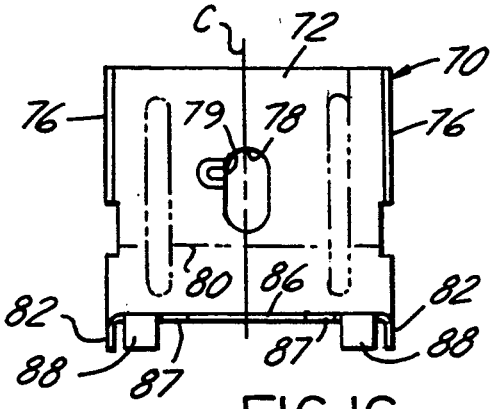
FIG. 16 is a detail end view of the clip taken in the direction of arrow "FIG. 16" in FIG. 14.
Figure 17:
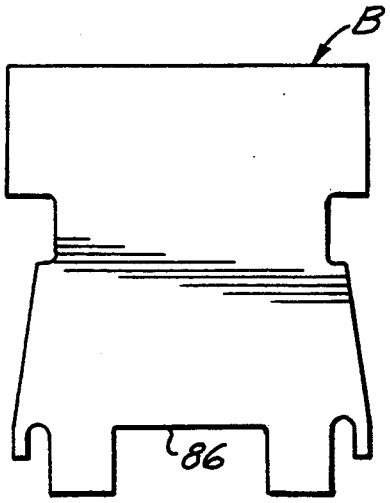
FIG. 17 is a plan view of the sheet metal blank from which the attachment clip of FIGS. 11–16 is formed.

A vertically elongated fastener slot 78 of predetermined length is provided in the head panel aligned on the axis "C" of FIG. 16. The slot 78 is designed to permit predetermined vertical slidable travel of the clip 70 upon its pre-installed attachment on the housing. The clip is shown attached to the housing by means of the tapping screw shank 67 extending through the slot 78 prior to being threadably received in the housing hub blind bore 62. In FIG. 11, it will be seen that an inboard indented raised land 79 is formed in the clip head panel adjacent the upper end of the slot 78. As viewed from the inboard side in FIG. 15, the land 79 provides a wedging surface located along the right hand vertical edge of the slot and is raised above the inboard face of the clip head portion 72.

Figure 5:
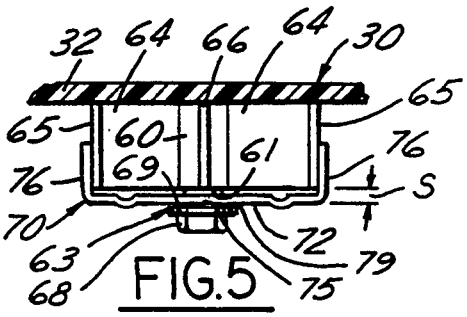
FIG. 5 is a fragmentary top view, partly in section, taken on the line 5—5 of FIG. 4.

With reference to FIG. 5, it will be appreciated that upon the screw 63 being tightened in a clockwise direction an underside portion 75 (FIG. 19) of the driving head collar 69 contacts the raised land 79. As the clockwise rotating collar is torqued down on the raised land 79, it imparts a downwardly directed force on the clip thereby insuring that the clip remains in its predetermined lowermost seated position of FIG. 8. The land 79 obviates the clockwise rotating screw from lifting the clip from its seated design position which may occur if the principal axis of the screw 63 is tipped off-center while it is being threaded into the housing bore 62.

It will be seen in FIG. 5 that with the tapping screw 63 threadably tightened to an initial clip preinstalled position its screw flange underside 75 is spaced a predetermined axial dimension "S" from hub face 61. The clip 70 is thus slidably attached to the housing 30 in its preinstalled mode by means of the clip head panel side flanges 76 closely straddling the pair of housing guide fins 65. By virtue of this arrangement, the housing guide fins 65 and the clip elongated slot 78 insure that the clip head panel 72 follows a predetermined gravity induced downward path.

With reference to FIG. 5, it will be appreciated that the inboard free edges of the gussets 64, the guide fins 65, and the hub fin 66 together with the hub face 61 establish a predetermined vertical plane. Thus, final tightening of the tapping screw 63 positions the head panel 72 on such inboard free edges and hub face in the established vertical plane. It will be noted in FIG. 14 that the clip head panel 72 and base panel 74 join at bend juncture 80 defining an obtuse included angle "Y" of the order of a hundred and ten degrees (110 degrees).

Figure 14:
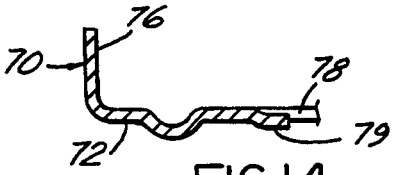
FIG. 14 is a cross-sectional view along line 14—14 of FIG. 12.

The clip body panel 74 has each of its side edges provided with a downturned cam flange 82 integrally joined to the sides of the body panel 74. It will be noted in FIGS. 15 and 16 that the pair of cam flanges 82 are substantially co-planar with their associated guide flanges 76. FIG. 14 shows each cam flange 82 provides a cam edge runner 83 sloped at a predetermined angle "Z" from the horizontal. Further, each cam flange 82 terminates in a horizontal outboard extending foot portion 84 projecting outboard from free transverse edge 86 of the base panel 74.

With reference to FIGS. 11 and 14, the base panel 74 additionally has a pair of substantially horizontal locating fingers 87 projecting outboard a predetermined dimension from the base panel free edge 86. The fingers 87 are disposed in a mirror image manner on either side of a plane of symmetry which includes the dashed center line "C" of FIG. 16. The fingers 87 are laterally spaced so as to define a central notch sized to receive the lower panel aperture lug 28 therein. A vertically downwardly bent retaining tab 88 is shown struck from an opposite side edge of each finger 87. Thus, each right-angled downturned tab 88 is positioned between its associated outer foot 84 and inner locating finger 87.

Figure 4:
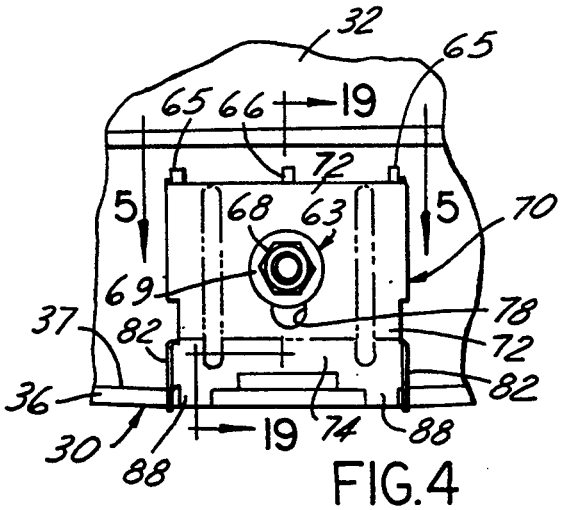
FIG. 4 is a fragmentary view of the door handle housing central inboard area showing the attaching clip in its pre-installed position.
Figure 19A:
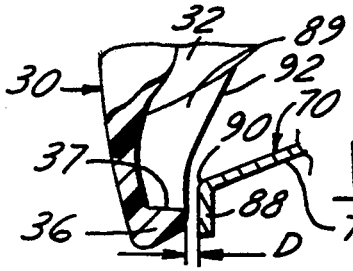
FIG. 19A is an enlarged fragmentary sectional view of the lower portion of FIG. 19.
Figure 19:
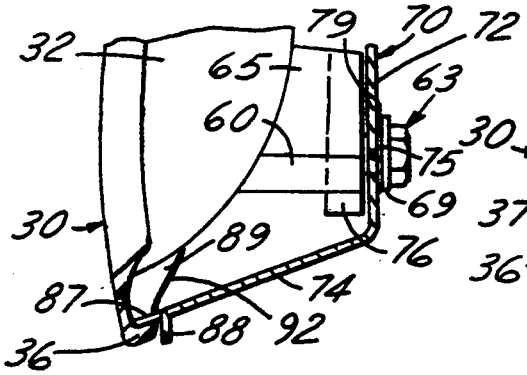
FIG. 19 is a fragmentary vertical sectional view taken on the line 19—19 of FIG. 4.

As best seen in FIGS. 3, 9 and 19, the housing lower terminal flange portion 36 has formed thereon a pair of vertically disposed fillet ramps 89. As seen in FIG. 9, the ramps 89 are equally spaced on either side of a vertical plane, defined by dashed construction line "X" that includes the principal axis of the hub blind bore 62. It will be noted in FIG. 4 that the ramps 89 are laterally spaced a predetermined dimension such that each ramp 89 is aligned with the center of an associated downturned tab 88.

It will be observed in FIG. 19 that in its preinstalled mode the handle housing clip 70 has a first preinstalled gravity induced predetermined position on the housing. Thus, in the clip's first pre-installed position the pair of locating fingers 87 are shown supported in overlying contact on the housing lower terminal flange ledge 37. It will be seen in enlarged FIG. 19A that each tab outboard face spaced a predetermined dimension "D" from opposed backside of the housing terminal flange 36.

As depicted in FIG. 5, the clip member head panel central vertical slot 78 is adapted to receive the threaded tapping screw 63 for pre-assembly retention of the clip member 70. Upon initially tightening the screw 63 in the housing blind bore 62 to a pre-installed setting, the undersurface of the screw head flange 69 is spaced a predetermined clearance dimension "S" from the free end 61 of the central hub 60. It will be seen in FIG. 19 that the clearance space "S" allows the clip sufficient freedom for guided movement either upwardly and inboard or downwardly and outboard in a manner to be explained below. Thus, the clip pair of locating fingers 87 project outboard a predetermined dimension sufficient to engage the terminal flange 37 to support the clip in its pre-installed first position of FIG. 19.

Figure 20:
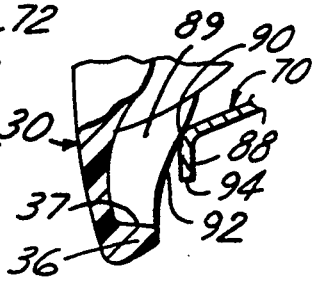
FIG. 20 is an enlarged fragmentary sectional view of the lower portion of FIG. 7.

FIG. 10 shows the locating fingers 87 in the clip's installed position contacting the edge of aperture flanged border 22 thus preventing clip rotation while maintaining the clamp bearing load. With reference to FIG. 20, it will be seen that each downturned tab 88 has a radiused juncture 90 which is adapted, upon the clip being cammed upwardly, to initially contact its associated angled ramp edge 92 as seen in FIG. 20.

Figure 7:
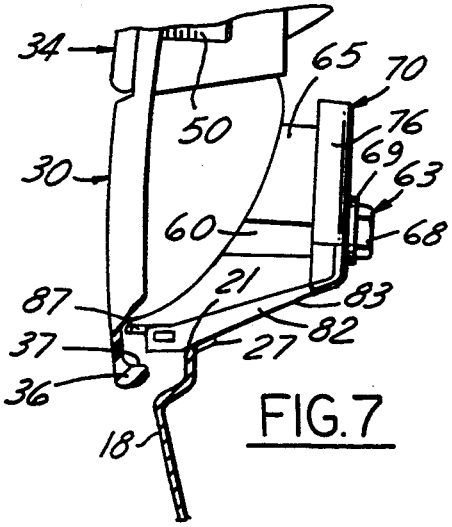
FIG. 7 is a view similar to the lower portion of FIG. 6 showing the clip being cammed upwardly by the panel aperture bottom edge.
Figure 8:
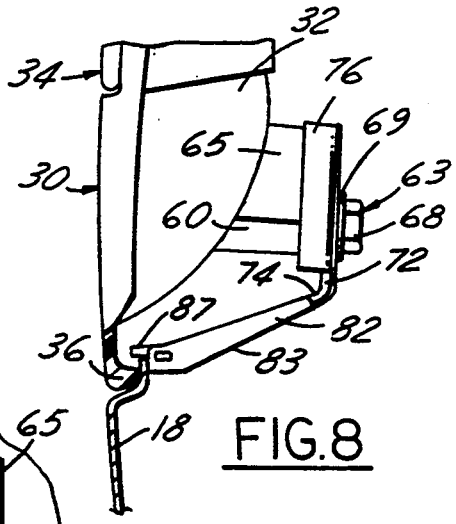
FIG. 8 is a view similar to FIG. 7 after the attachment clip nut has been torqued down on the threaded stud to its housing installed and locked position.

In operation, the installation sequence is depicted in FIG. 6–8. FIG. 6 shows the handle assembly 20 being installed in the elongated oval-like aperture 21 from the outboard side of the panel 18. The installer first tilts the handle assembly inboard toward the horizontal so as to project the upstanding crankarms 47 and 49 through the panel aperture 21. As the crankarms are received in the panel aperture, upper longitudinal edge 100 of the handle 34 is seated in longitudinally extending notched juncture 102 defined by the recessed flanged border 22. It will be noted that at the same time the housing 30 is longitudinally positioned in the aperture the pair of threaded studs 50 are aligned with their associated panel mounting slots 25 and 26 and received therein. By virtue of this arrangement, the handle portion 100 and the notched juncture 102 establish an installation pivot "P". The installation pivot "P" provides a swing-line axis enabling the installer to rock the housing into the aperture along a predetermined arcuate swing-line shown at 104 in FIG. 6.

As a result of swingline travel, the cam edge runners 83 are moved into sliding contact with the aperture lower edge 21. Thus, the clip 70 is cammed upwardly on the housing, as depicted in FIG. 7, while being vertically tracked by its outer guide flanges 76 straddling the housing inner guide fins 65 together with the clip vertical guide slot 78 sliding on the screw stem 67.

It will be seen in FIG. 20 that the clip initially moves substantially vertically until each tab radiused junctures 90 contacts its associated ramp edge 92 causing inboard travel of the clip 70. The ramp edge 92 is formed at a predetermined acute angle from the horizontal such that as each tab lower edge 94 is cammed above the aperture edge 21 the clip inboard travel continues until the tabs 88 are positioned inboard of the aperture flanged border 22. At this instant, the cam edge runners 83 clear the edge of aperture 21 allowing the clip 70 to fall under the influence of gravity from its elevated second position to its third installed position of FIG. 10. Upon the nuts 51 being threaded on the upper stems 50 the installer completes the installation by tightening the screw 63 whereby each of the tabs 88 exerts a clamp load against the flanged border 22 securing the handle assembly in the panel aperture.

While there is described above the principles of this invention in connection with a specific embodiment, it is to be clearly understood that this description is made only by way of example and not as a limitation to the scope of this invention.

What is claimed is:

1. A handle assembly adapted for mounting on a vehicle panel aperture, said handle assembly comprising:

a handle housing having a central body portion formed with a terminal flange presenting a backside thereof, the panel having an aperture formed with a flanged border, said housing adapted for mounting within the panel aperture with said flange backside adapted to seat on the panel flanged border;

fastener means on said housing adapted for securing an upper portion of said housing terminal flange on the panel aperture flanged border;

said housing body portion having central clip support means projecting inboard therefrom adapted to guide a retaining clip thereon between a first preinstalled position, a second installation induced elevated position and a third gravity induced installed position;

said clip having a generally L-shaped configuration in vertical section comprising an upstanding head panel and a base panel extending outboard toward a lower portion of said terminal flange, screw fastener means cooperating with said housing support means having an initial clip setting attaching said clip on said housing in said first position;

said housing, upon being partially inserted in the panel aperture, establishing an installation pivot with the panel enabling said housing to be rocked about the pivot along a predetermined swingline whereby said backside of said housing terminal flange is seated on said flanged border;

cam means on said clip base panel adapted to slidably contact a lower free edge of the panel aperture flanged border during insertion of said housing therein causing said clip to be raised in a predetermined manner whereby tab means on said clip base panel clear the aperture lower edge;

said cam means being configured such that just prior to said housing terminal flange backside being seated on the aperture flanged border said cam means being disengaged therefrom permitting said clip tab means to clear the aperture lower edge during installation;

ramp means on said housing operative to move said clip inboard as said clip is being raised such that, upon the gravity induced travel .of said clip to its third position, said tab means are located juxtaposed interior surface portions of said flanged border;

whereby upon said first mentioned fastener means being secured and said screw fastener means being tightened to a final setting resulting in said tab means being clamped against said flanged border interior surface releasably locking said handle assembly in the panel aperture.

2. The handle assembly as set forth in claim 1 wherein said tab means in the form of a pair of symmetrically arranged tabs downturned from an outboard edge of said clip base panel.

3. The handle assembly as set forth in claim 1 wherein said housing ramp means in the form of a pair of fillet ramps having a ramp edge formed at a predetermined acute angle from the horizontal adapted to be engaged by a radiused juncture of an associated tab means with said clip base panel.

4. The handle assembly as set forth in claim 1 wherein said clip base panel has an outboard edge formed with a pair of outboard projecting fingers and the lower portion of said terminal flange formed with recessed ledge means, whereby with said clip in its pre-installed position each said clip finger being supported on said ledge means.

5. The handle assembly as set forth in claim 1 wherein said clip head panel provided with a vertically extending slot receiving said screw fastener means therethrough, said slot having a predetermined vertical extent permitting said clip to travel vertically between said pre-installed position and said second position.

6. The handle assembly as set forth in claim 5 wherein said clip head panel is formed with an inboard indented land at a predetermined location adjacent a right-hand vertical edge of said slot, whereby upon said screw fastener means, having a driving head collar, being torqued in a clockwise manner, an underside of said driving head collar contacts said land so as to impart a downward force on said clip thereby insuring said clip is secured in its installed position.

7. The handle assembly as set forth in claim 1 wherein said housing central clip support means comprising a central inboard projecting hub formed with a blind bore adapted to receive said screw fastener means therein upon said screw fastener means extending through a vertical slot in said clip head panel.

8. The handle assembly as set forth in claim 7 wherein said clip is symmetrically disposed about a vertical plane of symmetry, said clip head panel having its opposite side edges provided with vertically disposed side flanges, and a pair of vertically disposed guide fins integrally formed on said housing and equally spaced on either side of said hub, said clip head panel side flanges spaced apart a predetermined dimension so as to straddle said guide fins whereby said side flanges track said guide fins providing predetermined vertical travel of said clip head panel relative to said guide fins.

9. The handle assembly as set forth in claim 7 wherein said central clip support means further comprising a pair of horizontally disposed gussets extending from either side of said hub and defining a plane that includes the principal axis of said blind bore, a pair of vertically disposed integral guide fins extending inboard from said housing body portion, said guide fins being equally spaced on either side of a central fin extending vertically upwardly from said hub, each said guide fin having a lower end thereof integrally joining an outer end of an associated horizontal gusset at a right angle juncture, whereby the free inboard edges of said gussets, said guide fins and said central fin defining a vertically disposed plane adapted to support said clip head panel thereon with said clip in its handle assembly installed position.

10. The handle assembly as set forth in claim 1 wherein said clip base panel has side edges formed with mirror image downturned cam flanges, each said cam flange having a lower edge tapered at a predetermined slope angle such that upon being slidably contacted by a lower portion of the panel aperture flanged border during installation of said handle assembly raising said clip to said elevated position.

* * * * *